United States Patent [19]

Kowalik et al.

[11] 4,105,881

[45] Aug. 8, 1978

[54] CIRCUIT BREAKER APPARATUS WITH STATIC PRESSURE LOCK

[75] Inventors: Peter M. Kowalik, Penn Township, Allegheny County; Stanislaw A. Milianowicz, Monroeville, both of Pa.

[73] Assignee: Westinghouse Electric Corp., Pittsburgh, Pa.

[21] Appl. No.: 709,848

[22] Filed: Jul. 29, 1976

[51] Int. Cl.[2] ..... H01H 33/64

[52] U.S. Cl. ..... 200/148 B; 29/622; 200/302; 220/359

[58] Field of Search ..... 200/148 R, 148 A, 148 B, 200/148 C, 148 F, 148 E, 148 G, 148 BV, 302; 220/359; 215/232; 29/622

[56] References Cited

U.S. PATENT DOCUMENTS

| | | | |
|---|---|---|---|
| 681,774 | 9/1901 | Bailey | 215/232 X |
| 724,443 | 4/1903 | Culp | 215/232 X |
| 1,208,355 | 12/1916 | Nechamkus | 220/359 |
| 2,757,261 | 7/1956 | Lingal et al. | 200/148 B |
| 3,286,066 | 11/1966 | Floessel | 200/148 B |
| 3,685,682 | 8/1972 | Frey | 220/359 |
| 3,733,452 | 5/1973 | Strippoli et al. | 200/148 A |
| 3,801,727 | 4/1974 | Wilkinson et al. | 220/359 X |
| 3,801,762 | 4/1974 | Noack | 200/148 A |
| 3,825,148 | 7/1974 | Hunter et al. | 220/359 |
| 3,902,031 | 8/1975 | McConnell | 200/148 A |
| 3,959,577 | 5/1976 | Frink | 200/148 B X |

*Primary Examiner*—Stephen Marcus
*Attorney, Agent, or Firm*—M. J. Moran

[57] ABSTRACT

An enclosed cylindrical vessel has a cover which is keyed to the vessel. The vessel encloses the separable main contacts and operating mechanism of a circuit interrupter. One of the terminals for the circuit interrupter is disposed on the side of the cylindrical vessel. The other terminal comprises the cover. It is keyed to the inside of the cylindrical vessel with a contiguous mass of hardened epoxy cement. The contiguous mass exists in hardened form between an indentation in the inner wall of the cylindrical vessel and an indentation in the outer wall of the cover-terminal. This prevents the cover from being forced out of the end of the cylindrical terminal by the pressure of gas inside. In addition, radial holes are disposed in the side walls of the cylindrical vessel. The contiguous mass of hardened epoxy material also occupies the latter holes and prevents the terminal cover from rotating in the vessel.

28 Claims, 1 Drawing Figure

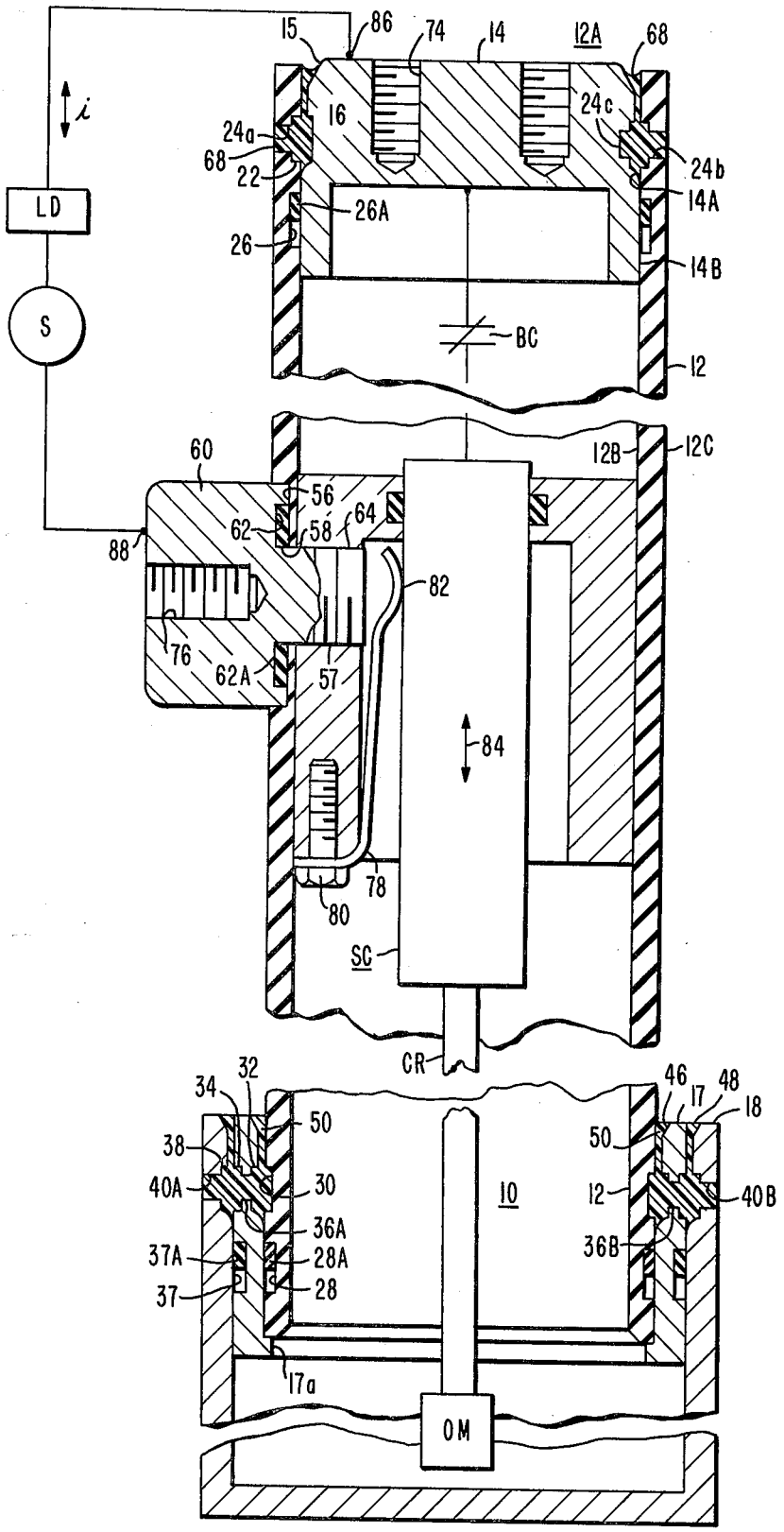
15
86
74
14
12A
68
i
16
24c
24a
68
22
24b
14A
LD
26A
26
14B
S
BC
12
60
12B
12C
56
64
62
58
88
82
76
62A
57
84
78
80
SC
CR
32
34
46
17
48
18
50
38
50
40A
30
10
12
40B
36A
37A
28A
36B
37
28
17a
OM

CIRCUIT BREAKER APPARATUS WITH STATIC PRESSURE LOCK

BACKGROUND OF THE INVENTION

The subject matter of this invention is related generally to means for locking a cover to a container and it relates more specifically to hardened epoxy keys for maintaining a cover-terminal in place in a gas pressurized circuit breaker vessel.

It is known in the prior art to provide seals and locking means for the covers of vessels. Generally the locking means takes the form of a snap ring and the seal takes the form of an annular ring, "O" ring or washer. Examples of the following are found in U.S. Pat. Nos. 1,020,480, patented Mar. 19, 1912 by P. E. G. Cumberland; 2,390,445, patented Dec. 4, 1945 by J. Mercier; and 3,660,593, patented May 12, 1972 by A. G. Bowles. It is also known to utilize fluid material such as asphalt or epoxy to contribute to the sealing or locking function. Such examples are shown in U.S. Pat. No. 2,165,964, issued July 11, 1939 to R. H. Earle et al; U.S. Pat. No. 3,109,552, issued Nov. 5, 1963 to K. Miller; and U.S. Pat. No. 3,825,148, issued July 23, 1974 to R. F. Hunter et al. None of the above arrangements show the utilization of a hardened epoxy key for holding or keying the cover in place on the vessel. None of the above arrangements show the utilization of an annular seal and a tapered cover. It would be advantageous to have epoxy keying material and a tapered leader for utilization with a neoprene seal or the like.

SUMMARY OF THE INVENTION

In accordance with the invention, method and apparatus are taught for keying a cover to the side walls of a cylindrical vessel. The inner wall of the cylindrical vessel has an annular groove inscribed or otherwise placed therein. Likewise, the outer wall of a cylindrical cover, which fits snugly into the tube, has a similar annular ring inscribed therein. The cover is disposed in the tube so that the annular rings align. Non-hardened or fluid epoxy material is then applied to the regions of the annular rings either through an opening in the side wall of the vessel which communicates with the annular ring therein or through an opening between the top of the vessel and the top of the cover, which is formed by tapering the cover. The fluid epoxy material fills the entire region between the aligned annular rings to thus harden and form a key which substantially interlocks the cover to the vessel. Since the cover is tapered on the top, it may be inserted into the vessel and pushed well into the inside portion of the vessel and a neoprene or similar sealing ring may be disposed in a second annular ring inscribed on the inside wall of the vessel. Glue may be placed on the inside and outside of the inner ring and the cover may be pulled back towards the opened end of the vessel until the widest part, i.e. largest diameter of the cover contacts the neoprene annular ring, thus forming a fluid tight seal. Radial holes may be drilled or bored into the indentations in the cover and/or in the vessel. The epoxy material when fluid fills the radial holes, thus providing a radial key when hardened.

BRIEF DESCRIPTION OF THE DRAWINGS

For a better understanding of the invention, reference may be had to the accompanying FIGURE which shows circuit breaker apparatus in section and partially broken away utilizing the concepts of the present invention.

DESCRIPTION OF THE PREFERRED EMBODIMENTS

Referring now to the drawing, a circuit breaker apparatus or vessel 10 is shown comprising a cylindrical tube 12 and a cover 14. The circuit breaker apparatus may comprise a gas-filled pressurized circuit breaker having a set of main breaker contacts BC (shown closed) interconnected with a sliding contact SC and operated by an operating mechanism OM. The sliding contact is interconnected with the operating mechanism by a connecting rod CR. The sliding contact SC and the breaker contacts BC may be conveniently interconnected with an external electrical circuit comprising a source of electrical power S and a load LD. An electrical current i, which may be alternating electrical current, may flow through the load LD and be susceptible to control by operation of the breaker contacts BC. The interconnection of the load LD and the breaker contacts BC will be described more fully hereinafter. Breaker contacts BC, the sliding contact SC, the connecting rod CR, the operating mechanism OM, the load LD and the source S are all shown in schematic block diagram form for convenience of illustration. It is to be noted that the breaker contacts BC are shown in a closed position, but may be opened by reorientation of the sliding contact SC as it is controlled by the connecting rod CR and the operating mechanism OM. The gas of the circuit breaker apparatus may comprise sulfur hexafluoride gas ($SF_6$) uses of which in circuit breaker apparatus are well known. The gas-filled circuit interrupter apparatus 10 may be viewed as a vessel. The vessel comprises the cylindrical tube 12 and the attached cover, stopper, or plug 14 for the opened end 12A of the cylindrical tube 12. In the preferred embodiment of the invention the cylindrical tube 12 is electrically insulating and hollow. The cover 14 is an electrically conducting end piece connector or terminal. In the preferred embodiment of the invention the inside portion of the tube 12 comprises an inside wall 12B while the outside portion of the tube 12 comprises an outside wall 12C. Likewise, the electrically conducting end piece connector plug 14 is generally cylindrically shaped to snugly fit against the inside wall 12B. Plug 14 has an outside surface 14A. In the preferred embodiment of the invention surface 14A tapers inwardly at 15 from a larger diameter 14B. In the preferred embodiment of the invention the end piece terminal 14 has inscribed on the outer cylindrical surface 14A (preferably in the region of the taper 15) an annular ring or indentation 16 which either completely or partially circumscribes the cylindrical terminal 14. Preferably the annular groove or ring 16 is parallel to the plane of the opened end 12A of the tube 12. The bottom portion of the cylindrical tube 12 generally snugly fits into cylindrical adapter 17 which has a lower lip **17*a* thereon against which the bottom of the cylindrical tube 12 abuts. In a like manner the outer surface of the cylindrical adapter 17 snugly fits into the inner surface of a cylindrical grounded base or operating mechanism housing 18. The adapter 17** may be composed of aluminum material.

There is provided on the upper portion of the inner surface or side wall 12B of the cylindrical tube 12 a first annular groove, indentation or ring 22 which is generally parallel to the plane of the opened end 12A of the tube 12. In the preferred embodiment of the invention the annular groove 16 of the end piece connector 14 and the annular groove 22 of the cylindrical tube 12 are longitudinally aligned. There may also be provided radially spaced bore holes or openings 24*a* and 24*b* in the tube 12 which may communicate with portions of the annular groove 22. In another embodiment of the invention the annular groove 22 and/or the annular groove 16 do not completely circumscribe the respective portions of the cylindrical inside wall 12B or the tapered portion 15 of the end piece connector 14, respectively. In such a case the bore holes 24*a* and 24*b* may communicate with the inner surface 12B of the cylindrical member 12 rather than the annular ring 22. In still another embodiment of the invention the bore holes 24*a* and 24*b* need not be present at all. In still another embodiment of the invention the bore holes may communicate with portions of the ring 22 and with portions of the side wall 12B. In still another embodiment of the invention a radially disposed bore hole or holes 24*c* may communicate with the annular ring 16 of the end piece connector or terminal 14. The utilization of the annular rings 16 and 22 and the various bore holes 24*a* through 24*c* will be described hereinafter. Also provided on the upper portion of the inner surface 12B of the cylindrical member 12 may be a gasket seat 26 which generally longitudinally aligns with the widest cylindrical portion 14B of the outside surface 14A of the end piece connector 14. On the lower portion of the outside surface 12C of the cylindrical tube 12 may be disposed or provided an annular groove ring or indentation 28 for seating a seal 28A. There may be also provided on the lower portion of the cylindrical vessel 12 above the seating indentation 28 an annular ring, groove or indentation 30 which is disposed on the outside wall 12C of the tube 12 and which is similar to the annular ring or indentation 22 which is disposed on the inside wall 12B of the vessel 12 as was described previously. In a like manner annular grooves 32 and 34 may be disposed on the inside wall and outside wall respectively of the adapter 17 and an annular groove 38 may be disposed on the inside wall of the ground base or operating mechanism housing 18. All of the latter mentioned annular grooves may be similar to the previously described annular grooves 16 and 22. In the preferred embodiment of the invention the annular grooves 30, 32 and 34 are aligned longitudinally. Furthermore, in a preferred embodiment of the invention a bore hole 40A in base 18 communicates with annular groove 38 on the left. Likewise, a bore hole 40B communicates with the same annular groove on the right. It is to be understood, as was the case with respect to bore holes 24*a* through 24*c* described previously, that the bore holes 40A and 40B may be aligned differently than is shown in the FIGURE either completely or in part or may not be present at all. It is also to be understood with respect to all of the bore holes 24*a* through 24*c* and 40A and 40B that their radial disposition may be different than is shown in the FIGURE. Corresponding bore holes 36A on the left and 36B on the right communicate with annular rings 32 and 34 in the adapter 17. The previously described limitations and variations for bore holes 24*a* through 24*c* and 40A and 40B likewise apply to bore holes 36A and 36B. Disposed on the outside surface of the adapter 17 is an annular ring, groove or indentation 37 for seating a seal 37A, as will be described in more detail hereinafter. In a preferred embodiment of the invention neoprene seals 26A, 28A and 37A are disposed in seats 26, 28 and 37, respectively. The adapter 17 and the ground base 48 have inside tapered portions 46 and 48 respectively, which are similar to the tapered portion 15 of the end piece connector or cover 14. The utilization of the tapers 15, 46 and 48 will be described in more detail hereinafter. Liquid epoxy material 50 may be disposed in the opening between the taper 46 and the outside wall 12C of the cylindrical member 12. Alternately or supplementary, the epoxy material 50 may be introduced into the region between the outside wall of the adapter 17 and the taper 48 of the ground base 18. The liquid material 50 may be introduced through the bore holes 40A or 40B or directly through the appropriate tapered openings. Regardless of how the liquid epoxy material 50 is supplied into the previously described regions, it is desirous to have the liquid epoxy material fill the regions comprising the annular rings 30, 32, 34 and 38, for example, as well as the radially disposed holes 40A and 40B and 36A and 36B. The liquid epoxy material 50 is then allowed to harden in place to form keys, some of which having generally rectangular cross sections for generally holding the members 12, 17 and 18 immovable longitudinally relative to each other. The rectangular keys are in grooves 30, 32, 34 and 38. Furthermore, the disposition of fluid material 50 in the bore holes 40A and 36A and 40B and 36B, for example, holds the members 12, 17 and 18 generally immovable radially relative to each other. Consequently, it can be seen that the use of liquid epoxy material 50 in the region of the various annular rings and radial bores provides keys for securing the members one to the other and preventing longitudinal and radial motion or movemet, even under gas pressurized within the internal portion of the circuit interrupter apparatus 10.

There is disposed in the outside wall 12C of the electrically insulating cylindrical tube 12 a radial circular indentation or seat 56. In the middle of the circular indentation or seat 56 is disposed a hole 58 which communicates with the inside wall 12B of the tube 12 or the internal portion of the vessel 10. A circular terminal 60 having an annular ring 62 on an inside portion thereof is disposed against the seating region 56 such that a protruding portion 57 of the terminal 60 is present within the internal portion of the gas-filled vessel 10. A neoprene seal 62A is disposed in compressed relationship between the seat region 62 and the surface of the indentation 56 to seal the inside portion of the vessel 10 from the region outside of the vessel 10. This is similar to the way in which seals 26A, 28A and 37A act to seal the gas-filled region within the internal portion of the vessel 10 from the external portion of the vessel 10. Disposed inside the vessel 10 and in electrically conducting interrelationship with the protruding nub 57 of the terminal member 60 is a securing member or interconductor 64. Typically, the protruding portion 57 of the terminal 60 has an external thread thereon which corresponds with an internal thread in the interconductor 64. Consequently, the terminal 60 may be threaded down upon the interconductor 64 at that part of the tube side wall 12 in the vicinity of the seat 56 and bore hole 58 to securely hold the terminal 60 in sealed relationship to the wall 12C.

At the upper end of the cylindrical shell 12, fluid epoxy material 68 is introduced into the region between the end piece connector 14 and the hollow cylindrical shell 12 through either the opening between the wall 12 and the taper 15 of the cover 14 or through one of the bores 24A or 24B. The material is allowed to flow into all of the open spaces which it can reach where it is subsequently hardened to form a key or epoxy weld for keeping the terminal 14 relatively immovable longitudinally and/or radially with respect to the tube 12. Once hardened, the epoxy material 68, like its counterpart material 50 in the lower portion of the circuit breaker apparatus 10, forms a solid contiguous mass. The square or rectangular cross section of the hardened mass in the vicinity of the annular rings 22 and 16 prevent longitudinal movement of the end piece connector 14 relative to the shell 12 and the presence of the bores 24A, 24B and/or 24C prevent substantial rotary or circumferential movement thereof. The top end piece connector or electrical terminal 14 may have longitudinal holes 74 disposed therein for mounting bus bar or electrical conductor apparatus to the terminal 14. Likewise, the side mounted terminal 16 may have a central opening 76 for mounting a bus bar or an electrical conductor thereto.

An electrically conducting spring member 78 may be secured to the interconductor stud 64 by way of a bolt or similar fastening means 80 so that sliding electrical connection between the sliding contact SC and a region 82 of the spring loaded electrically conductive member 78 may be provided. The sliding contact SC may move in the directions shown by the arrows 84 to open or close the main breaker contacts BC. The external circuit comprising the load LD and the source S is shown schematically connected to the top terminal 14 at the point 86 and to the side terminal 60 at the point 88. Consequently, it can be seen that a continuous electrical circuit exists when the breaker contacts BC are closed for the current *i*. The electrical circuit includes the load LD, the source S, the side mounted terminal 60, the internal conductor 64, the spring loaded flexible conductor 78, the sliding contact SC, the closed contacts BC and the top terminal 14.

A method is taught for securing various portions of the circuit breaker apparatus 10 to one another. In particular, adhesive glue may be disposed on all sides of the neoprene seal or gasket 62A. The gasket 62A is then placed in its seat 62 and the bolt-like terminal 60 is then threaded into the internal conductor 64, thus compressing the glued neoprene seal between the terminal 60 and the side wall 12C of the tube 12. In a like manner, the neoprene gasket 28A may be glued on all sides thereof and inserted into the annular indentation or seat 28 at the bottom of the shell 12. The shell 12 may then be inserted downwardly into the aluminum adapter 17. This is possible because the inside taper 46 on the adapter 17 provides a leader for the insertion of the shell 12 with its seal 28A. The insertion process may continue until the bottom portion of the shell 12 abuts against the lip 17*a*. The neoprene seal 37A is inserted in the seat 37 on the outer circumferential surface of the cylindrical adapter 17. Once again, glue may be disposed entirely around the neoprene seal to hold it in place and to form a tighter seal between the surfaces to which it adheres after assembly. The assembled aluminum adapter 17 and circumferential shell 12 is inserted into the cylindrical opening of the ground base and operating mechanism housing 18. This is aided by the use of the leader formed by the taper 48 on the inner surface of the upper region of the housing 18. When the aluminum housing has been fully inserted into the ground base to its appropriate depth, the seal 37A is slightly compressed and adheres to the inner surface of the housing 18 and the outer surface of the seat 37. Of course as was mentioned previously, the compression of the seal 28A between the inner surface of the adapter 17 and the outer surface of the seat 28 performs the same function for that joint. The upper terminal 14 may be inserted by fitting it into the upper end 12A of the cylindrical shell 12 and pushing it downward into the cylindrical shell 12 past the region of the annular seat 26. The neoprene seal 26A, having appropriate cement disposed on any or all surfaces thereof may then be placed in the groove or seat 26. The terminal 14 is then moved upwardly to the position shown in the FIGURE. As the enlarged portion 14B of the outer surface 14A of the terminal 14 passes the neoprene seal 26A, it compresses the seal. At this point the upward movement of the terminal 14 is stopped. The seal 26A is firmly disposed between the outer surface of the seat 26 and the inner surface 14A of the terminal 14.

After the appropriate seals are placed the liquid epoxy 68, 50, for example, may be applied to fill the various regions previously discussed. After the epoxy has been allowed to harden, the assembly process is essentially complete. Each of the joints has a snugly fitting neoprene seal and a keyed weld of hardened epoxy material associated therewith. Consequently, gas within the internal portion of the gas-filled circuit apparatus 10 is not only substantially prevented from escaping therefrom, but also is substantially prevented from dislodging various parts of the now assembled circuit breaker apparatus. It can be seen that this is especially critical with regard to the terminal 14 and the shell 12. It can be seen that this arrangement is somewhat similar to the arrangement of a bullit within a rifle barrel. The pressurized gas beneath the terminal 14, as shown in the FIGURE, has a tendency to force the terminal 14 upward and outward from the mouth at the upper end 12A of the vessel 12. The key provided by the hardened epoxy material 68 in the aligned grooves or indentations at 16 and 22 provides a weld or lock for keeping the terminal 14 affixed in place in the barrel 12 of the circuit breaker apparatus 10. It will be noted that the upper corners of the grooves 22 and 16 as viewed in the FIGURE provide discontinuities in the contiguous mass of hardened epoxy material 68. This provides a more significant holding force than gently rounded annular grooves would provide. Likewise, the radially disposed bores 24*a*, 24*b* and/or 24*c*, for example, prevent substantial rotation of the terminal 14 about its axis within the shell 12.

It is to be understood with respect to the embodiments of this invention that the apparatus need not be predominantly circular or cylindrical about its central longitudinal axis. It may be rectangular or square, in which case the need for radial keys would be significantly reduced or completely diminished. It is also to be understood that the presence of all of the interconnecting joints, such as between elements 12 and 17, 17 and 18 and 12 and 14, for example, are not necessarily limiting but are only exemplary of the preferred embodiment of the invention. It is also to be understood that the presence of the side mounted terminal 60 is not limiting. It is also to be understood that the leaders provided by the tapers 15, 46 and 48 are not limiting but are useful in applying the various seals. It is also to be understood with regard to the method described for assembling the circuit breaker apparatus 10 that the steps may be reversed or interchanged and some steps may be deleted. It is also to be understood that the terminals 14 and 16 are primarily electrically conducting whereas the barrel 12 is primarily electrically insulating and may comprise such material as fiberglass. It is also to be understood that the presence of the glue or cement on the various seals is not limiting. It is also to be understood that the internal arrangement of the circuit parts, such as the circuit breaker contacts BC and the sliding contact SC, are not limiting. It is also to be understood that the internal region of the circuit breaker 10 may be at a relatively lower pressure than the external region. The seals previously discussed will maintain the pressure differential and the welds or keys of hardened epoxy will prevent substantial movement of the parts one to the other. It is also to be understood that in some embodiments of the invention the judicious use of the liquid epoxy 68 may be such that the epoxy welds themselves may form seals in replacement of or supplemental to the sealing provided by the various gaskets described herein. It is also to be understood that the various annular grooves or indentations, such as 30, 32, 34, 38, 16 and 22, need not be continuous around the inner or outer surfaces of the elements in which they are disposed. In other embodiments of the invention one of the grooves may be continuous while the other groove is intermittent. In still another embodiment of the invention, both sets of grooves may be intermittent. In still another embodiment of the invention the tapers, such as 15, 46 and 48, may be completely missing, and the upper portion of the apparatus or elements upon which the tapers were originally disposed may be dimensioned to exactly correspond to the element upon which they are to fit. In such a case the epoxy resin may be introduced through the bore holes such as **24*a*, 40B** and the like.

The apparatus embodying the inventive concepts taught herein has many advantages. One advantage lies in the fact that the various portions of pressurized gas circuit breaker apparatus or the like may be keyed to one another by utilizing fluid epoxy which fills various voids to thus later produce hardened keys which hold the various elements generally immovable one to the other. Another advantage lies in the fact that the weld material may form gaskets. Another advantage lies in the fact that separate gaskets may be used which are tightly compressed between various portions of the apparatus. The use of a relatively rectangular gasket rather than a well-known "O" ring is of greater advantage because of the larger surface area for performing the sealing function. Another advantage lies in the fact that the sealing techniques taught herein and the method may be utilized for other apparatus besides circuit breaker apparatus. Another advantage lies in the fact that the assembly method taught provides for more efficient sealing and welding of one part to the other with an easier operation.

What we claim as our invention is:

1. Circuit interrupter apparatus, comprising:

a. a vessel for containing pressurized gas at the time of current interruption and having an opening therein, said vessel having a plurality of indentations on a portion thereof proximate to said opening;

b. cover means for protruding into and closing said opening, said cover means having a plurality of indentations on the portion thereof which protrudes into said opening and which align with an equal number of said indentations in said vessel;

c. a mass of hardened material disposed originally as fluid material in each of a sufficient number of said cover means indentations and said aligned vessel indentations to key said cover means to said vessel to prevent substantial movement of said cover means away from said vessel under the pressure of said gas;

d. separable contact means disposed within said vessel for making and breaking an electrical circuit in a gaseous atmosphere;

e. operating means interconnected mechanically with said separable contact means for opening and closing said separable contact means; and f. electrical terminal means disposed upon said vessel in electrical relationship with said separable contact means and adapted to interconnect said contact means with said electrical circuit.

2. The combination as claimed in claim 1 wherein said electrical terminal means is disposed on a portion of said vessel means which is spaced from said cover means.

3. The combination as claimed in claim 1 wherein said vessel and said cover means have a gasket interposed therebetween to substantially prevent fluid leakage.

4. The combination as claimed in claim 1 wherein said cover means comprises an electrical terminal which is interconnectable with said electrical circuit.

5. The combination as claimed in claim 1 wherein said vessel comprises a cylindrical insulating tube, said terminal means being disposed on the side of said tube.

6. Circuit interrupter apparatus, comprising:

a. a vessel for containing pressurized gas at the time of current interruption and having an opening therein, said vessel having a continuous indentation on a portion thereof proximate to said opening;

b. cover means for protruding into and closing said opening, said cover means having a continuous indentation on the portion thereof which protrudes into said opening and which aligns with said continuous indentation in said vessel;

c. a mass of hardened material disposed originally as fluid material in said cover means indentations and said aligned vessel indentation to key said cover means to said vessel to prevent substantial movement of said cover means away from said vessel under the pressure of said gas;

d. separable contact means disposed within said vessel for making and breaking an electrical circuit in a gaseous atmosphere;

e. operating means interconnected mechanically with said separable contact means for opening and closing said separable contact means; and f. electrical terminal means disposed upon said vessel in electrical relationship with said separable contact means and adapted to interconnect said contact means with said electrical circuit.

7. The combination as claimed in claim 6 wherein said electrical terminal means is disposed on a portion of said vessel means which is spaced from said cover means.

8. The combination as claimed in claim 6 wherein said vessel and said cover means have a gasket interposed therebetween to substantially prevent fluid leakage.

9. The combination as claimed in claim 6 wherein said cover means comprises an electrical terminal which is interconnectable with said electrical circuit.

10. The combination as claimed in claim 6 wherein said vessel comprises a cylindrical insulating tube, said terminal means being disposed on the side of said tube.

11. Circuit interrupter apparatus, comprising:

a. a vessel for containing pressurized gas at the time of current interruption and having an opening therein, said vessel having a plurality of indentations on a portion thereof proximate to said opening;

b. cover means for protruding into and closing said opening, said cover means having a continuous indentation on the portion thereof which protrudes into said opening and which aligns with indentations in said vessel;

c. a mass of hardened material disposed originally as fluid material in each of a sufficient number of said indentations and said aligned continuous cover indentation to key said cover means to said vessel to prevent substantial movement of said cover means away from said vessel under the pressure of said gas;

d. separable contact means disposed within said vessel for making and breaking an electrical circuit in a gaseous atmosphere;

e. operating means interconnected mechanically with said separable contact means for opening and closing said separable contact means; and f. electrical terminal means disposed upon said vessel in electrical relationship with said separable contact means and adapted to interconnect said contact means with said electrical circuit.

12. The combination as claimed in claim 11 wherein said electrical terminal means is disposed on a portion of said vessel means which is spaced from said cover means.

13. The combination as claimed in claim 11 wherein said vessel and said cover means have a gasket interposed therebetween to substantially prevent fluid leakage.

14. The combination as claimed in claim 11 wherein said cover means comprises an electrical terminal which is interconnectable with said electrical circuit.

15. The combination as claimed in claim 11 wherein said vessel comprises a cylindrical insulating tube, said terminal means being disposed on the side of said tube.

16. Circuit interrrupter apparatus, comprising:

a. a vessel for containing pressurized gas at the time of current interruption and having an opening therein, said vessel having a continuous indentation on a portion thereof proximate to said opening;

b. cover means for protruding into and closing said opening, said cover means having a plurality of indentations on the portion thereof which protrudes into said opening and which align with portions of said continuous indentation in said vessel;

c. a mass of hardened material disposed originally as fluid material in each of a sufficient number of said cover means indentations and said aligned continuous vessel indentation to key said cover means to said vessel to prevent substantial movement of said cover means away from said vessel under the pressure of said gas;

d. separable contact means disposed within said vessel for making and breaking an electrical circuit in a gaseous atmosphere;

e. operating means interconnected mechanically with said separable contact means for opening and closing said separable contact means; and f. electrical terminal means disposed upon said vessel in electrical relationship with said separable contact means and adapted to interconnect said contact means with said electrical circuit.

17. The combination as claimed in claim 16 wherein said electrical terminal means is disposed on a portion of said vessel means which is spaced from said cover means.

18. The combination as claimed in claim 16 wherein said vessel and said cover means have a gasket interposed therebetween to substantially prevent fluid leakage from said vessel.

19. The combination as claimed in claim 16 wherein said cover means comprises an electrical terminal which is interconnectable with said electrical circuit.

20. The combination as claimed in claim 16 wherein said vessel comprises a cylindrical insulating tube, said terminal means being disposed on the side of said tube.

21. Circuit interrupter apparatus, comprising:

a. a hollow, cylindrical, electrical insulating vessel, said vessel having one end thereof opened, said vessel having an annular indentation on the inside wall thereof proximate to said opened end and generally parallel thereto;

b. separable contact means disposed within said vessel for making and breaking an electrical circuit;

c. operating means interconnected mechanically with said separable contact means for opening and closing said separable contact means;

d. electrical terminal means disposed upon said vessel in electrical relationship with one terminal of said separable contact means, said terminal means being adapted to be interconnected with an electrical circuit the current carrying status of which is determinable by the state of said separable contact means;

e. an electrically conducting terminal having a generally circular cross section which corresponds to the inner cross section of said vessel at said one end; said terminal having an annular indentation on the outside surface thereof, said terminal being oriented in said opened end of said vessel to close said open end, said indentation of said terminal being aligned with said indentation of said vessel, said terminal being disposed in electrical relationship with another terminal of said separable contact means, said terminal being adapted to be interconnected with said electrical circuit; and f. a contiguous mass of hardened material being disposed in said indentation of said vessel and said indentation of said terminal to key said terminal to said vessel to prevent substantial longitudinal movement of said terminal relative to said vessel.

22. The combination as claimed in claim 21 wherein said terminal is tapered inwardly at that end thereof which is opposite the internal portion of said hollow vessel.

23. The combination as claimed in claim 21 wherein said vessel has a radially disposed indentation therein in which said hardened mass is present for preventing substantial rotation of said terminal relative to said vessel.

24. The combination as claimed in claim 21 wherein gasket means is disposed between the inner wall of said vessel and the outside surface of said terminal, said gasket means making said vessel generally fluid tight.

25. A method for covering an opening in a gas containing vessel with cover means, comprising the steps of:

a. placing a plurality of keying indentations on a portion of said vessel proximate to said opening;

b. placing a plurality of keying indentations on a portion of said cover means;

c. placing a gasket indentation on a portion of said vessel, wherein said vessel keying indentations are closer to the opened end of said vessel than said gasket indentation is;

d. disposing said cover means in said opening at a distance therein which is further from said opening than either said vessel keying indentations or said gasket indentations;

e. inserting a gasket in said gasket indentation;

f. moving said cover means towards said opening to overlap said gasket and align an equal number of vessel keying indentations and cover means keying indentations;

g. disposing fluid material which may be subsequently hardened in each of a sufficient number of cover means keying indentations and aligned vessel keying indentations to subsequently key said cover means to said vessel; and h. hardening said fluid material into a mass to key said cover means to said vessel to prevent substantial movement of said cover means relative to said vessel.

26. A method for covering an opening in a gas containing vessel with cover means, comprising the steps of:

a. placing a continuous keying indentation on a portion of said vessel proximate to said opening;

b. placing a continuous keying indentation on a portion of said cover means;

c. placing a gasket indentation on a portion of said vessel, wherein said vessel keying indentation is closer to the opened end of said vessel than said gasket indentation is;

d. disposing said cover means in said opening at a distance therein which is further from said opening than said vessel keying indentation or said gasket indentation;

e. inserting a gasket in said gasket indentation;

f. moving said cover means towards said opening to overlap said gasket and align said vessel keying indentation and said cover means keying indentation;

g. disposing fluid material which may be subsequently hardened in said cover means keying indentation and said aligned vessel keying indentation to subsequently key said cover means to said vessel; and h. hardening said fluid material into a mass to key said cover means to said vessel to prevent substantial movement of said cover means relative to said vessel.

27. A method for covering an opening in a gas containing vessel with cover means, comprising the steps of:

a. placing a continuous keying indentation on a portion of said vessel proximate to said opening;

b. placing a plurality of keying indentations on a portion of said cover means;

c. placing a gasket indentation on a portion of said vessel, wherein said vessel keying indentation is closer to the opened end of said vessel than said gasket indentation is;

d. disposing said cover means in said opening at a distance therein which is further from said opening than said vessel keying indentation or said gasket indentation;

e. inserting a gasket in said gasket indentation;

f. moving said cover means towards said opening to overlap said gasket and align portions of said continuous vessel indentation with said cover means indentations;

g. disposing fluid material which may be subsequently hardened in each of a sufficient number of cover means keying indentations and said aligned portions of said vessel keying indentation to subsequently key said cover means to said vessel; and h. hardening said fluid material into a mass to key said cover means to said vessel to prevent substantial movement of said cover means relative to said vessel.

28. A method for covering an opening in a gas containing vessel with cover means, comprising the steps of:

a. placing a plurality of keying indentations on a portion of said vessel proximate to said opening;

b. placing a continuous keying indentation on a portion of said cover means;

c. placing a gasket indentation on a portion of said vessel, wherein said vessel keying indentations are closer to the opened end of said vessel than said gasket indentation is;

d. disposing said cover means in said opening at a distance therein which is further from said opening than said vessel keying indentations or said gasket indentation;

e. inserting a gasket in said gasket indentation;

f. moving said cover means towards said opening to overlap said gasket and align said vessel indentations and portions of said continuous cover means indentation;

g. disposing fluid material which may be subsequently hardened in each of a sufficient number of vessel keying indentations and said aligned portions of said cover means keying indentation to subsequently key said cover means to said vessel; and h. hardening said fluid material into a mass to key said cover means to said vessel to prevent substantial movement of said cover means relative to said vessel.

* * * * *